US006223627B1

(12) United States Patent
Jan et al.

(10) Patent No.: US 6,223,627 B1
(45) Date of Patent: May 1, 2001

(54) ANTI-SHOCK STRUCTURE OF A HAMMER HANDLE

(76) Inventors: Yi Jing Jan, 5, Lane 191 Shi Shinq Rd. Her Meei Town; Hui Jen Wang, 398, Sec 2 Jong Shan Rd. Hua Tantarn Shian, both of Changhua Hsien (TW)

( * ) Notice: Subject to any disclaimer, the term of this patent is extended or adjusted under 35 U.S.C. 154(b) by 0 days.

(21) Appl. No.: 09/461,567

(22) Filed: Dec. 14, 1999

(51) Int. Cl.[7] ..... B25D 1/00
(52) U.S. Cl. ..... 81/22; 81/27; 81/490
(58) Field of Search ..... 81/22, 27, 490, 81/177.4

(56) References Cited

U.S. PATENT DOCUMENTS 4,738,166 * 4/1988 Yamaguchi .
5,490,437 * 2/1996 Hebert et al. .
5,926,911 * 7/1999 Chen .

* cited by examiner

*Primary Examiner*—Timothy V. Eley
*Assistant Examiner*—Willie Berry, Jr.
(74) *Attorney, Agent, or Firm*—Pro-Techtor International Services

(57) ABSTRACT

An anti-shock structure of a hammer handle comprises a main rod, a handle sleeve, an elastic element, and a plug. A longitudinal storing slot is disposed inside the handle sleeve. The elastic element is disposed in the longitudinal storing slot. One end of the elastic element has a U-shaped portion. The elastic element's cross-sectional width is less than the longitudinal storing slot's cross-sectional width. So, during the swinging movement before knocking, the U-shaped portion of the elastic element will resist the reactive force so as to ensure the excellent holding effect. After the knocking, an opened portion of the elastic element will absorb the shock. That is, both excellent holding effect and the anti-shock function are achieved.

2 Claims, 7 Drawing Sheets

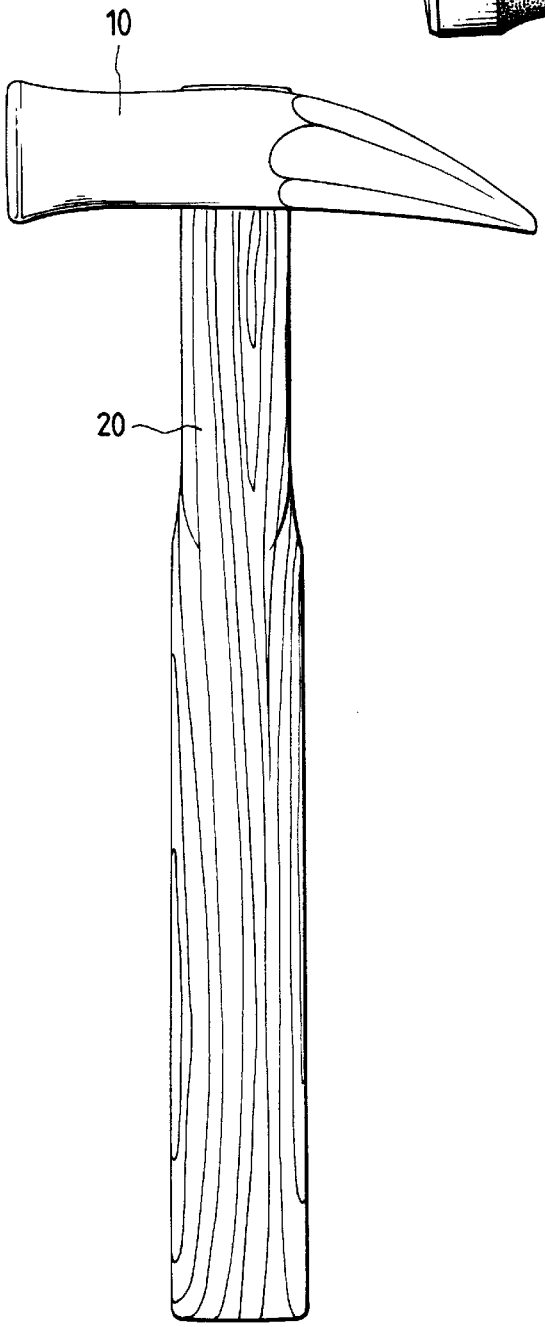
FIG,1
PRIOR ART
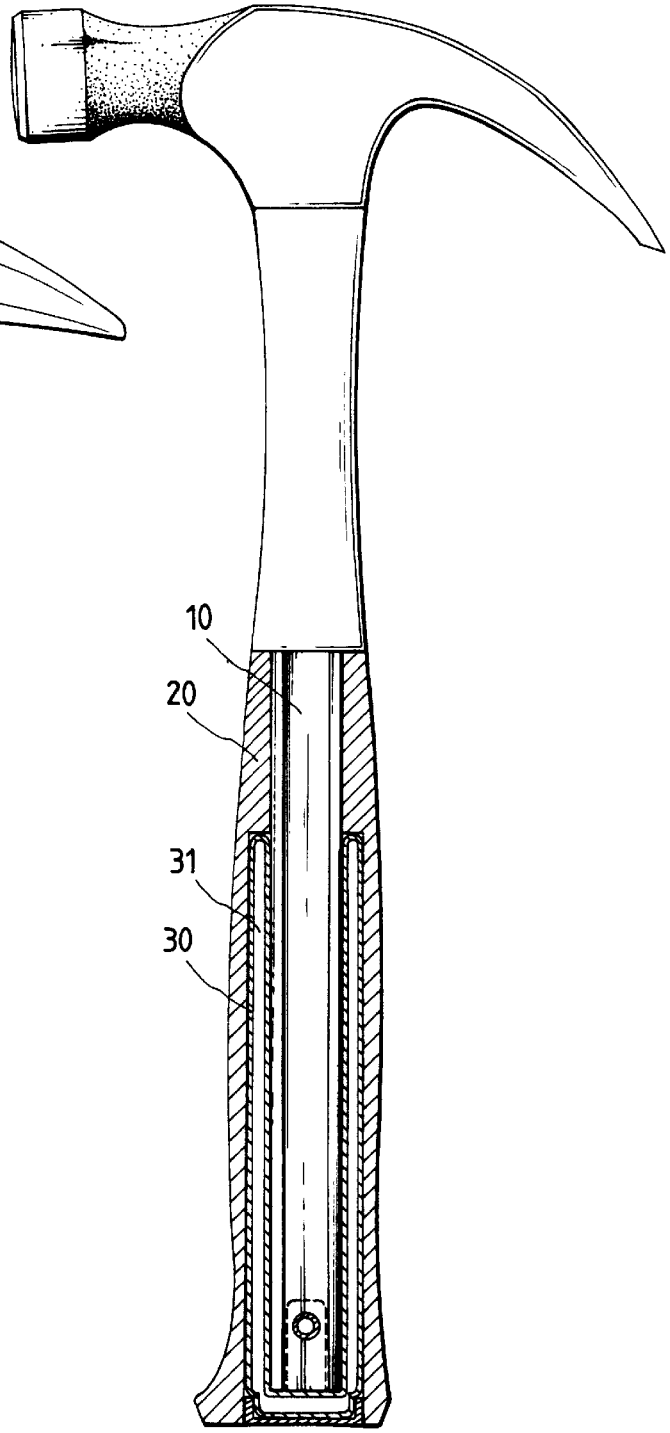
FIG,2
PRIOR ART

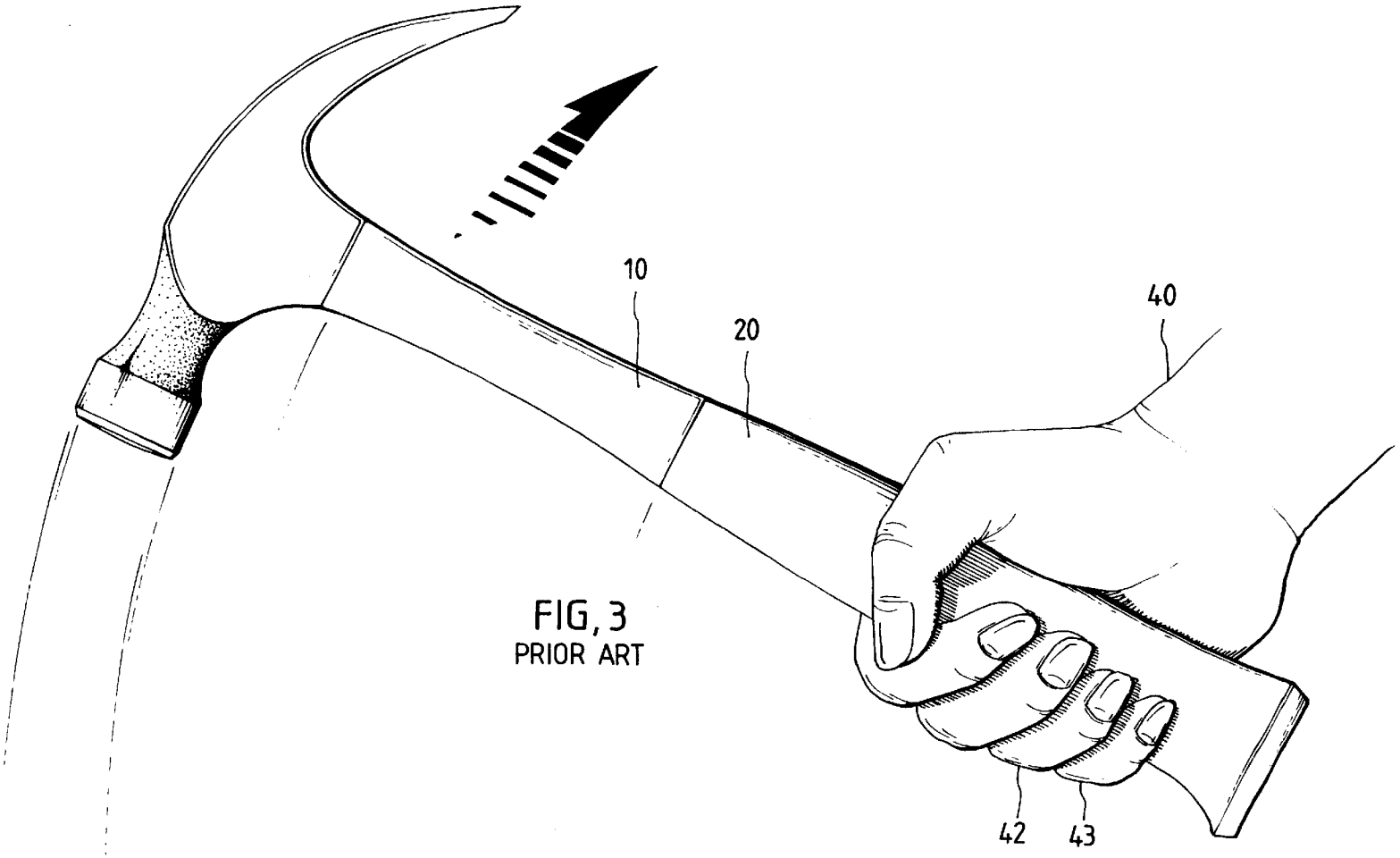
FIG, 3
PRIOR ART

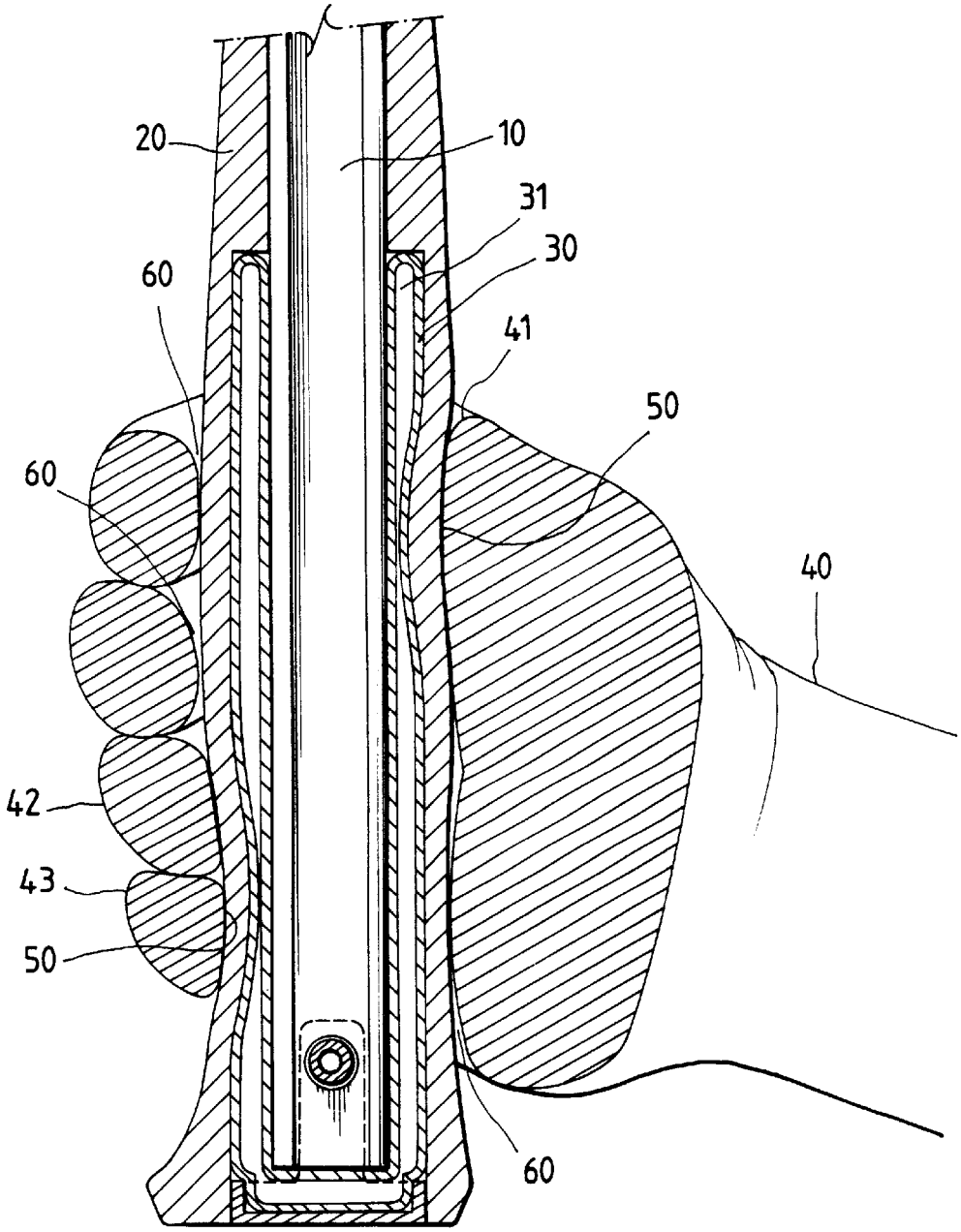
FIG, 4
PRIOR ART

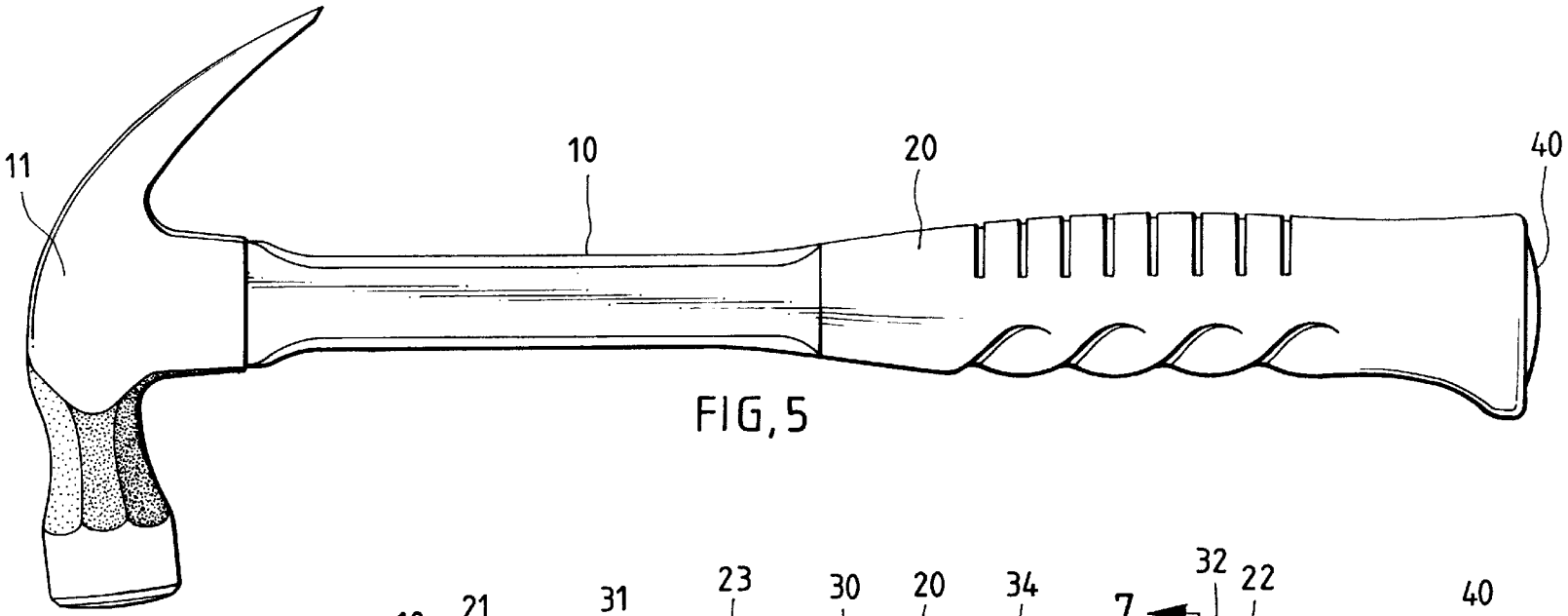
FIG, 5
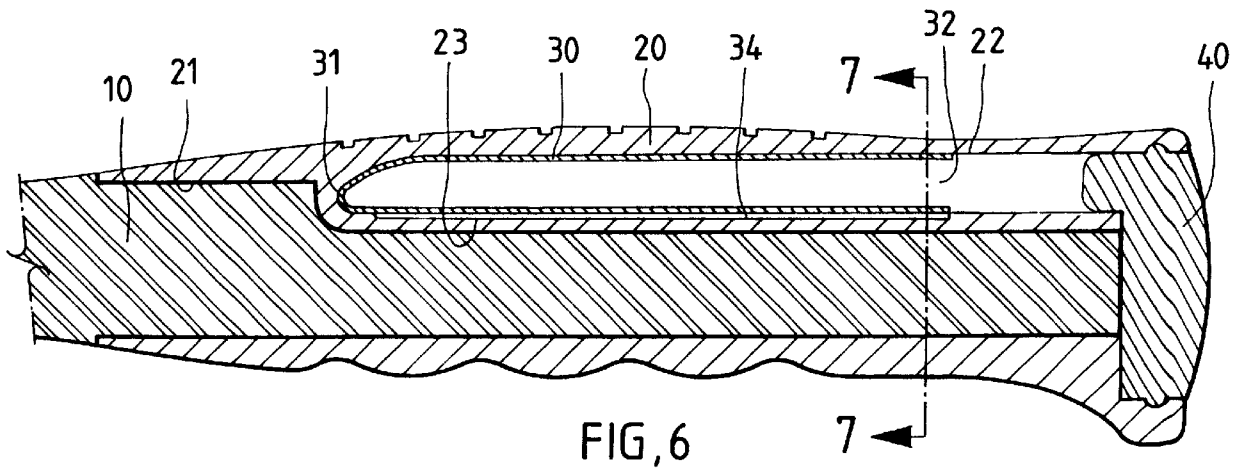
FIG, 6

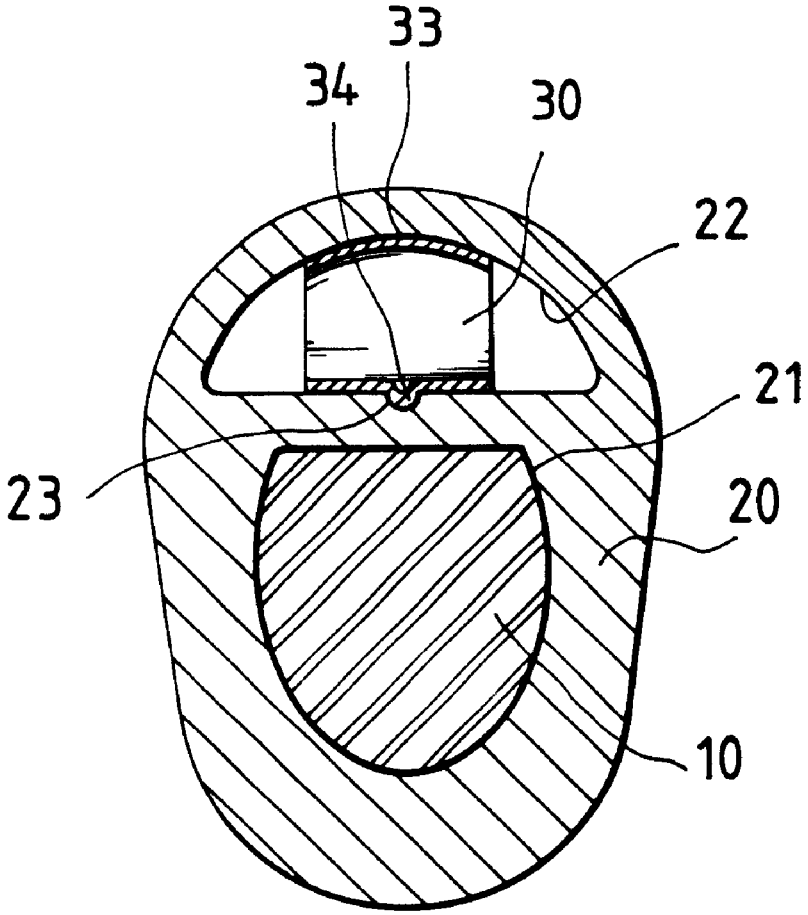
FIG, 7

ANTI-SHOCK STRUCTURE OF A HAMMER HANDLE

BACKGROUND OF INVENTION

1. Field of the Invention

The present invention relates to an anti-shock structure of a hammer handle. Especially, it relates to a hammer handle having a special elastic element inside so that an excellent holding effect and anti-shock function can be achieved.

2. Description of the Prior Art

As shown in FIG. 1, it is a conventional hammer structure. It includes a hammer head 10 and wooden handle 20 connected with. Because the wooden handle 20 is made from the trunk of a tree. It does not contain any anti-shock structure. During the knocking procedure, it is very possible to cause the holding is hard and to cause the user's hand numb due to the reactive force (or shock).

Another convention hammer structure was invented. Referring to FIGS. 2 to 4, a U-shaped air bag 30 is disposed between the main rod 10 and the handle sleeve 20. There is some air 31 sealed inside the air bag 30. Therefore, the air bag 30 between the main rod 10 and the handle sleeve 20 will absorb the reactive force during knocking. Thus, an anti-shock effect is achieved.

However, before knocking something, the user will swing he hammer up a little as a preparation step. Because this winging movement and according to the lever's law, a reactive force will apply on the connecting portion 41 between the thumb and the index finger, the ring finger 42 and the little finger 43. Thus, many recesses 50 are occurred corresponding to the positions of the connecting portion 41, the ring finger 42, and the little finger 43. Furthermore, it makes a little gap 60 is created on the holding portion of the hand 40. This will influence the holding effect between the hand 40 and the handle 20. And, there is a centrifugal force during the swinging movement before knocking. It will cause the risk of the hand 40 sliding out. If increasing the handle's thickness over he air bag 30, the absorbing and shrinking speed becomes slow and further influences its shock absorbing amount. Therefore, it is a dilemma about the anti-shock design.

SUMMARY OF THE INVENTION

The main object is to provide an anti-shock structure of a hammer handle comprising a main rod, a handle sleeve, an elastic element, and a plug; a longitudinal storing slot being disposed inside said handle sleeve, the elastic element being disposed in the longitudinal storing slot, one end of the elastic element having a U-shaped portion, the elastic element's cross-sectional width being less than the longitudinal storing slot's cross-sectional width. So, during the swinging movement before knocking, a U-shaped portion of the elastic element will resist the reactive force so as to ensure the excellent holding effect. After the knocking, an opened portion of the elastic element will absorb the shock. Thus, excellent holding effect and the anti-shock function are achieved.

BRIEF DESCRIPTION OF THE DRAWINGS

FIG. 1 shows a conventional hammer.

FIG. 2 shows the inner structure of the conventional hammer.

FIG. 3 illustrates the swinging condition of the conventional hammer.

FIG. 4 is a partially enlarged cross-sectional view of the conventional hammer from FIG. 3.

FIG. 5 is a plain view of the present invention.

FIG. 6 shows the inner structure of the present invention.

FIG. 7 is another enlarged cross-sectional view of the present invention.

DETAILED DESCRIPTION OF THE PREFERRED EMBODIMENT

Figure 8:
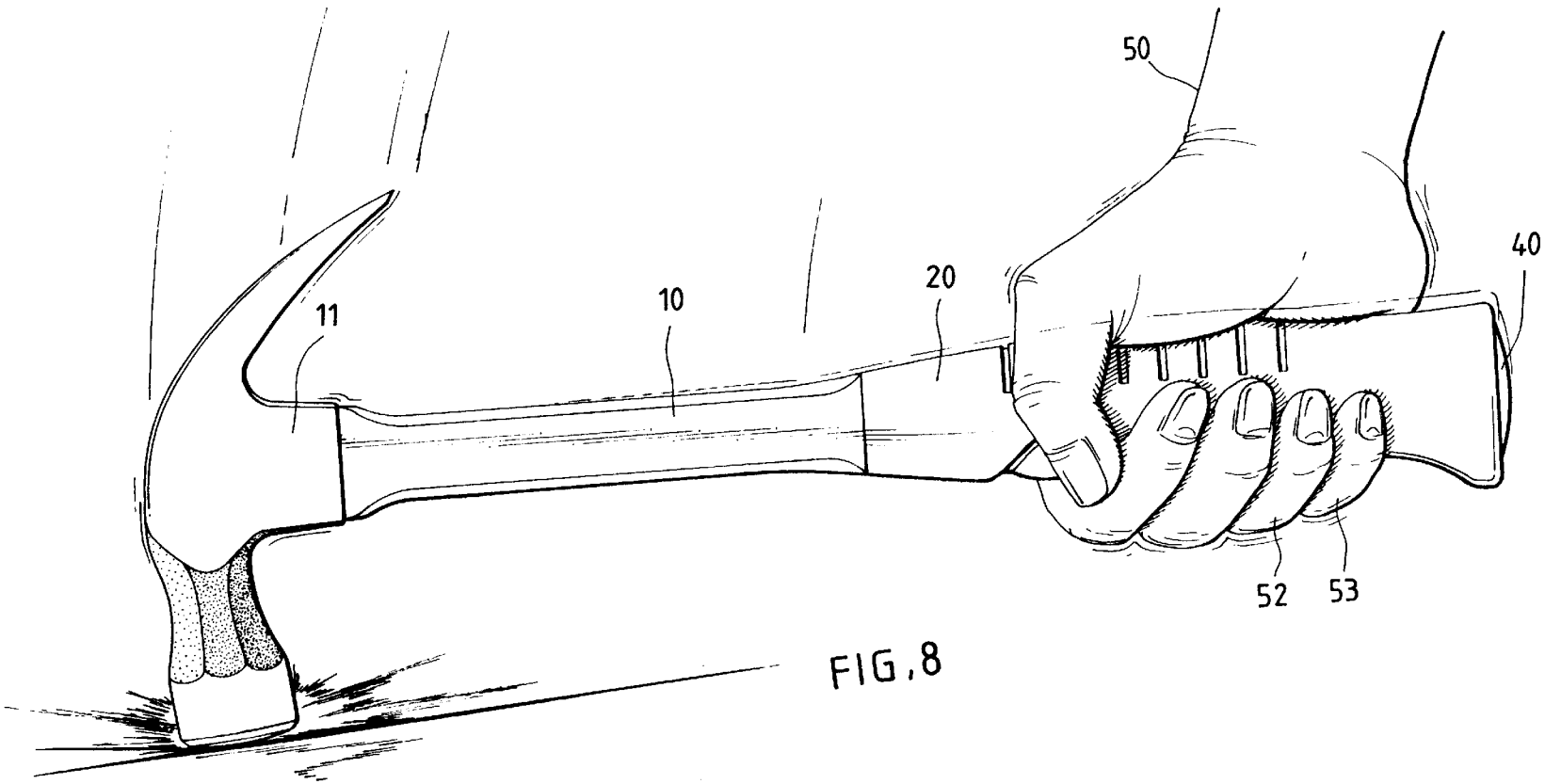
FIG. 8 illustrates the knocking condition of the present invention.

Referring to FIGS. 5 to 7, the present invention provides an anti-shock hammer structure of a hammer handle. It comprises: a main rod 10, a handle sleeve 20, an elastic element 30, and a plug 40.

In which, the main rod 10 is a rod-like structure. One end of the main rod 10 is disposed with a hammer head 11. The other end is provided for connected with the plug 40.

The handle sleeve 20 has a combining hole 21 for combining with the main rod 10. One side of the combining hole 21 is disposed with a semi-circular longitudinal storing slot 22. A positioning recess 23 is disposed on a bottom of the longitudinal storing slot 22.

With regard to the elastic element 30, it is a plate-like structure. One end of the elastic element 30 is a U-shaped portion 31. The other end of the elastic element 30 is an opened portion 32. The upper side of the elastic element 30 is a curved surface 30. The curve shape and size are almost equal to the ones of the semi-circular longitudinal storing slot 22. The opposite lower side of the elastic element 30 outwardly extends a positioning protrusion 34.

The plug 40 is to seal the end of the handle sleeve 20 and the longitudinal storing slot 22.

The combining hole 21 is to let the main rod 10 insert in and be firmly secured. The function of the longitudinal storing slot 22 is to store the elastic element 30 and to make the positioning protrusion 34 engage with the positioning recess 23 of the longitudinal storing slot 22. Then, after the plug 40 sealing the end of the handle sleeve 20, the assembling work is done. Or, put the main rod 10 and the elastic element 30 into a mold. Then, form the handle sleeve 20 by using the plastic injection method. Finally, put the plug 40 into the end of the handle to sealing it. It also can achieve the same result.

Figure 9:
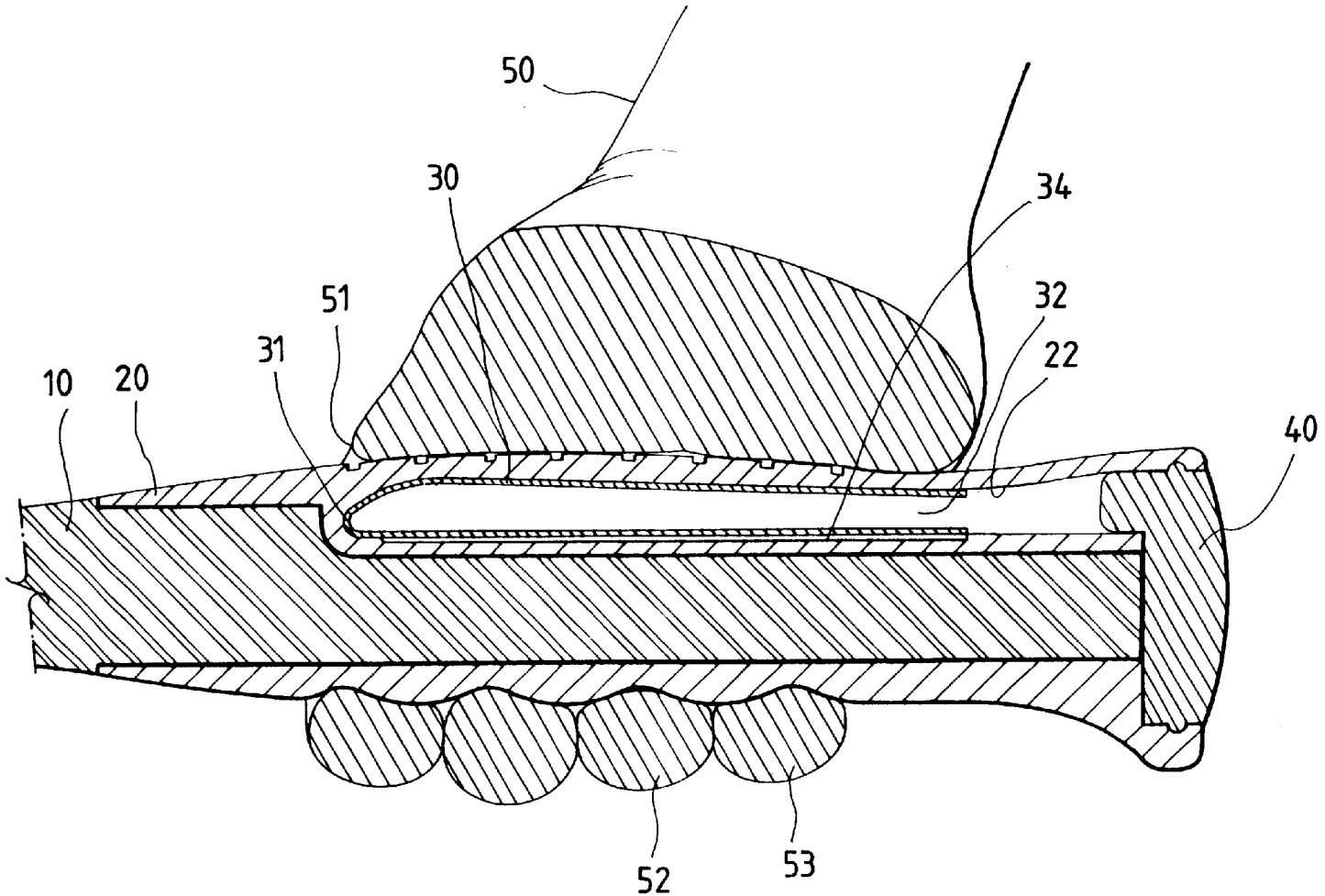
FIG. 9 is a partially enlarged cross-sectional view of the present invention from FIG. 8.

A user holds the handle sleeve 20 of the hammer. The connecting portion 51 between the thumb and the index finger of the user's hand 50 is facing the elastic element 30. If the user wants to knock something, there is a preparation step for swinging the hammer up. At this moment, due to this swinging movement, the hammer head 11 on the main rod 10 will create a reactive force on the connecting portion 51 between the thumb and the index finger, the ring finger 52 and the little finger 53. But, the reactive force is absorbed by the U-shaped portion 31 of the elastic element 30. So, no gap will occur between the main rod 10 and the user's hand 50 while swinging. Therefore, the holding effect is better and it can avoid the centrifugal force causing the sliding condition happened before knocking (as shown in FIG. 8). After the hammer head 11 knocking on the object, a serious reactive force occurs (as shown in FIG. 9). It significantly influences the wrist portion of the user. However, because the opened portion 32 of the elastic element 30 will absorb this force (or shock) so that the user's hand 50 will not feel a shock. Thus, the present invention achieves an anti-shock function.

The above embodiments are only used to illustrate the present invention, not intended to limit the scope thereof. Many modifications of the above embodiments can be made without departing from the spirit of the present invention.

What is claimed is:

1. An anti-shock structure of a hammer handle comprising:

a main rod, a handle sleeve, said handle sleeve includes a longitudinal slot disposed in an interior of said handle sleeve, an elastic element disposed in said longitudinal slot, at least one end of said elastic element having a U-shaped portion, and a plug; wherein a positioning recess is disposed on a bottom of said longitudinal slot, and a positioning protrusion is disposed on a bottom on said elastic element so that said positioning protrusion engages said positioning recess.

2. The anti-shock structure of a hammer handle as claimed in claim 1 wherein:

said longitudinal slot has a substantially semi-circular hole, and a corresponding surface of said elastic element is a curved surface so that when said elastic element is set in said longitudinal slot, said curved surface of said elastic element firmly contacts said substantially semi-circular hole in said longitudinal slot.

* * * * *